US006846527B2

(12) United States Patent
Monju et al.

(10) Patent No.: US 6,846,527 B2
(45) Date of Patent: Jan. 25, 2005

(54) THERMAL TRANSFER RECORDING MEDIA

(75) Inventors: Takuya Monju, Tochigi (JP); Hideaki Takahashi, Tochigi (JP)

(73) Assignee: Sony Chemicals Corp., Tokyo (JP)

( * ) Notice: Subject to any disclaimer, the term of this patent is extended or adjusted under 35 U.S.C. 154(b) by 0 days.

(21) Appl. No.: 09/411,322

(22) Filed: Oct. 4, 1999

(65) Prior Publication Data

US 2004/0202826 A1 Oct. 14, 2004

(30) Foreign Application Priority Data

Oct. 9, 1998 (JP) ..... 10-287168

(51) Int. Cl.[7] ..... B41M 5/40; B41M 3/12; B05D 3/02; B05D 1/36; B05D 7/00

(52) U.S. Cl. ..... 428/32.39; 427/152; 427/385.5; 427/407.1

(58) Field of Search ..... 428/32.39, 195, 428/480, 484, 500, 913, 914; 427/152, 385.5, 407.1; 347/217

(56) References Cited

U.S. PATENT DOCUMENTS 4,970,119 A * 11/1990 Koshizuka et al. ..... 428/411.1
5,279,884 A * 1/1994 Kitamura et al. ..... 428/195
5,720,839 A * 2/1998 Takahashi et al. ..... 156/230
6,099,967 A * 8/2000 Takahashi et al. ..... 428/32.85
6,150,008 A * 11/2000 Nakayama et al. ..... 428/195
6,156,416 A * 12/2000 Daems et al. ..... 428/213
6,174,607 B1 * 1/2001 Sugita et al. ..... 428/423.1

FOREIGN PATENT DOCUMENTS

| | | | |
|---|---|---|---|
| JP | 63-162287 | 7/1988 | |
| JP | 6-262859 | 9/1994 | |
| JP | 9-52451 | 2/1997 | |
| JP | 9-272269 | 10/1997 | |
| JP | WO98/08690 | * 5/1998 | ..... B41M/5/30 |

* cited by examiner

*Primary Examiner*—B. Shewareged
(74) *Attorney, Agent, or Firm*—Oliff & Berridge, PLC

(57) ABSTRACT

The present invention provides a thermal transfer recording medium having a solvent-resistant layer based on a polyester resin wherein an even ink layer is formed by coating on the solvent-resistant layer.

A thermal transfer recording medium 10 of the present invention comprises a solvent-resistant layer 2 based on a polyester resin on a substrate 1 and an ink layer 3 based on a ketone resin on the solvent-resistant layer 2. The solvent-resistant layer 2 contains a polyethylene wax in the range from 10 to 80% by weight of on the basis of the solid content of the solvent-resistant layer.

6 Claims, 1 Drawing Sheet

THERMAL TRANSFER RECORDING MEDIA

FIELD OF THE INVENTION

The present invention relates to thermal transfer recording media for forming images such as bar code images and characters on receiving objects such as papers, labels, etc., particularly to thermal transfer recording media that can form images and characters with good solvent resistance.

PRIOR ART

The thermal transfer recording technique consists in fitting a printer having a thermal head with a so-called thermal transfer recording medium having an ink layer formed on a base film and melt-transferring said ink layer onto a receiving paper to form images and characters.

This type of thermal transfer recording medium has been adapted to meet demands for images and characters with solvent resistance by inserting a colorless layer made of a highly solvent-resistant material between a base film and an ink layer to form the ink layer on this so-called solvent-resistant layer.

Images and characters generated with this recording medium can be expected to have high solvent resistance because the ink layer on the substrate is protected by the solvent-resistant layer. Waxes and resins have been proposed as materials for the solvent-resistant layer, depending on the nature of the solvent to be resisted. Particularly in the label industry, resistance to alcoholic solvents is often required, and therefore, the solvent-resistant layer is often selected from resins less soluble for alcoholic solvents such as acrylic resins, styrene resins, polyester resins, vinyl chloride resins, urethane resins, epoxy resins, etc.

Solvent-resistant thermal transfer recording media are commonly known to have low transferability because resins used for the solvent-resistant layer can not have low molecular weight and low softening point due to the necessity of keeping solvent resistance.

Attempts have been made to solve this problem, for example, by inserting a release layer between the base film and the solvent-resistant layer to enhance transferability or using an ink layer based on a thermoplastic resin such as ketone resins, petroleum resins, polyester resins, etc. to obtain high thermal adhesion during transfer. However, all the cases in which polyester resins were selected as resins for the solvent-resistant layer resulted in coated surfaces with significant unevenness, which in turn adversely affected printing.

SUMMARY OF THE INVENTION

The present invention was made to solve these problems of the prior art, and aims at a thermal transfer recording medium having a solvent-resistant layer based on a polyester resin wherein an even ink layer is formed by coating on the solvent-resistant layer.

As a result of our careful studies to solve the above problems, we accomplished the present invention on the basis of the finding that addition of a certain polyethylene wax to a solvent-resistant layer based on a polyester resin can improve coating properties of an ink layer based on a thermoplastic resin formed thereon.

The invention based on this finding relates to a thermal transfer recording medium comprising a substrate in the form of a film, a solvent-resistant layer formed on the substrate and mainly containing a polyester resin and a polyethylene wax, and an ink layer formed by coating on the solvent-resistant layer and based on a ketone resin.

The invention relates to a thermal transfer recording medium wherein the polyethylene wax is contained in the range from 10 to 80% by weight on the basis of the solid content of the solvent-resistant layer.

The invention relates to a thermal transfer recording medium wherein the polyethylene wax is contained in the range from 20 to 70% by weight on the basis of the solid content of the solvent-resistant layer.

The invention relates to a thermal transfer recording medium wherein the polyethylene wax is contained in the ink layer.

The invention relates to a thermal transfer recording medium wherein a release layer is formed between said substrate and said solvent-resistant layer.

The invention relates to a thermal transfer recording medium wherein a heat-resistant lubricant layer is formed on the side of the substrate opposite to the side on which the ink layer is formed.

The invention also relates to a process for preparing a thermal transfer recording medium, comprising the steps of applying a composition for forming a solvent-resistant layer mainly containing a polyester resin and a polyethylene wax on a substrate in the form of a film and drying it to form a solvent-resistant layer; and applying a composition for forming an ink layer based on a ketone resin on the solvent-resistant layer and drying it to form an ink layer.

The invention also relates to a process wherein the composition for forming a solvent-resistant layer is prepared by adding a dispersion of the polyethylene wax in a solvent to a solution of the polyester resin in a solvent.

The invention relates to a process wherein methyl ethyl ketone is used as the solvent.

The invention relates to a process wherein the composition for forming a solvent-resistant layer is applied and then dried under the conditions where the polyethylene wax in the solvent-resistant layer should not be molten.

According to the present invention, addition of a polyethylene wax to the solvent-resistant layer can improve coating properties of the ink layer based on a ketone resin on the solvent-resistant layer. The reason therefor is not exactly known, but may be probably because addition of a polyethylene wax (1) improves compatibility between the ketone resin and the polyester resin or (2) improves resistance to solvent used for coating the ketone resin such as methyl ethyl ketone, toluene, etc. to avoid damage of the surface of the solvent-resistant layer during coating.

According to the present invention as described above, the ink layer is evenly formed to provide a thermal transfer recording medium having high transferability, solvent resistance and printing quality.

BRIEF EXPLANATION OF THE DRAWINGS

Preferred embodiments of thermal transfer recording media of the present invention will now be described in detail with reference to the accompanying drawings in which.

Numeral references represent the following elements: 1: substrate; 2: solvent-resistant layer; 3: ink layer; 4: release layer; 5: heat-resistant lubricant layer; 10, 11: thermal transfer recording medium.

DETAILED DESCRIPTION OF THE INVENTION

Figure 1A:
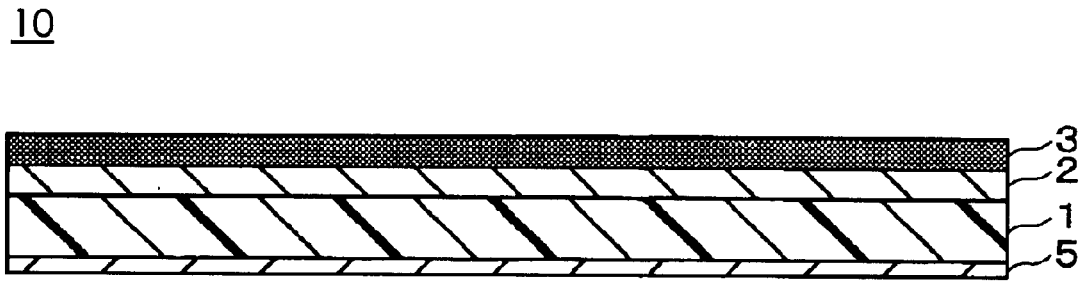
FIG. 1*a* is a block diagram showing an example of thermal transfer recording media of the present invention.
Figure 1B:
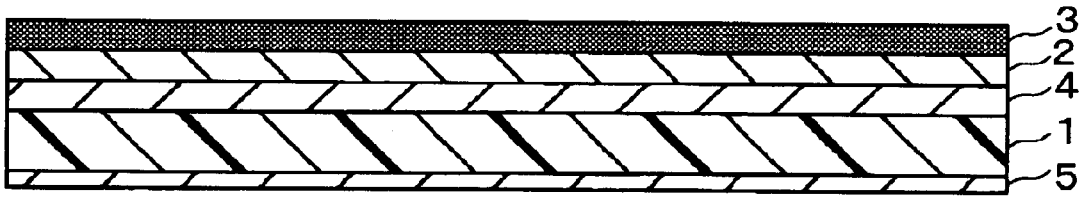
FIG. 1*b* is a block diagram showing another example of thermal transfer recording media of the present invention.

FIG. 1*a* shows an example of thermal transfer recording media of the present invention and FIG. 1*b* shows another example of thermal transfer recording media of the present invention.

As shown in FIG. 1*a*, a thermal transfer recording medium 10 of the present invention comprises a solvent-resistant layer 2 based on a polyester resin formed on a substrate 1 and an ink layer 3 containing a ketone-based solvent formed by coating on the solvent-resistant layer 2.

The substrate 1 used herein may be one of those used for conventional thermal transfer recording media, preferably including substrates made from papers such as condenser paper or parchment paper and substrates made from plastics such as polyester films, polyvinyl chloride films, polycarbonate films, etc.

From the viewpoints of heat transfer and strength, the thickness of the substrate 1 is preferably 2–12 $\mu$m, more preferably 3.5–6.5 $\mu$m.

The solvent-resistant layer 2 according to the present invention is based on a polyester resin and further contains a polyethylene wax therein.

The polyethylene wax here is preferably contained in the solvent-resistant layer 2 in the range from 10 to 80% by weight, more preferably 20 to 70% by weight, still more preferably 30 to 40% by weight on the basis of the solid content of the solvent-resistant layer 2.

If the amount of the polyethylene wax in the solvent-resistant layer 2 is less than 10% by weight, the benefits of the present invention can not be sufficiently achieved. If it exceeds 80% by weight, solvent resistance will be lowered.

The ink layer 3 according to the present invention is formed with an ink composition containing a ketone-based solvent, and this ink composition contains at least a colorant and a bonding resin.

The colorant used herein may be one of those conventionally used for thermal transfer recording media, preferably including carbon black and color pigments such as Carmine B (magenta), Yellow GL (yellow), Blue 4040 (cyan), Orange G (orange), etc.

Preferably, the bonding resin includes, for example, ketone resins in view of transferability to labels.

Preferably, the ketone-based solvent includes, for example, methyl ethyl ketone (MEK) in view of solubility and drying characteristics.

As shown in FIG. 1*b*, a release layer 4 may be formed between the substrate 1 and the solvent-resistant layer 2 according to the present invention. This release layer 4 has the role of improving transferability of the solvent-resistant layer 2 and the ink layer 3 during thermal transfer and adhering well to the substrate 1 and the solvent-resistant layer 2 to prevent peal off development of the solvent-resistant layer 2 and the ink layer 3 during normal state (out of thermal transfer).

Suitable materials for the release layer 4 include, for example, waxes such as carnauba wax, candelilla wax, rice wax, paraffin wax, polyethylene; or thermoplastic resins such as ethylene-vinyl acetate copolymers (EVA), polyester resins, styrene resins, etc.

The thickness of the release layer 4 may vary with the materials for other components such as the substrate 1 or the ink layer 3, printing conditions, etc., but preferably 0.5 g/m$^2$ in view of printing energy, coating properties and printing quality.

As shown in FIGS. 1*a* and *b*, a heat-resistant lubricant layer 5 may be formed from a known silicone copolymer or silicone oil on the side of the substrate 1 opposite to the side on which the ink layer 3 is formed, in order to enhance running properties of the thermal transfer recording media 10, 11.

The thickness of the heat-resistant lubricant layer 5 here is preferably 0.02–1.5 g/m$^2$ in view of performance as a lubricant layer and prevention of brocking to the ink layer 3.

The thermal transfer recording media 10, 11 of the present invention can be prepared according to conventional methods. For example, the thermal transfer recording medium 10 shown in FIG. 1*a* is obtained by applying a composition for forming a solvent-resistant layer on a substrate 1 and drying it to form a solvent-resistant layer 2, and then applying a composition for forming an ink layer 3 on the solvent-resistant layer 2 and drying it to form the ink layer 3.

The composition for forming a solvent-resistant layer here is preferably prepared by adding a dispersion of a polyethylene wax in a solvent such as methyl ethyl ketone to a solution of a polyester resin in a solvent such as methyl ethyl ketone.

During the step of forming the solvent-resistant layer 2, the composition for forming a solvent-resistant layer is applied and then dried preferably under the conditions where the polyethylene wax in the solvent-resistant layer 2 should not be molten.

As shown in FIG. 1*b*, a composition for forming a release layer may optionally be applied on the substrate 1 by gravure coating or the like and dried to form a release layer 4.

According to the present embodiments as described above, a specific amount of a polyethylene wax added to the solvent-resistant layers 2 improves resistance of the solvent-resistant layers 2 to ketone-based solvents during coating, so that the ink layers 3 can be evenly formed by coating.

The following examples further illustrate thermal transfer recording media of the present invention in contrast to comparative examples.

EXAMPLE 1

Preparation of a Composition for Forming a Release Layer

In 90 parts by weight of a solvent were dissolved 9 parts by weight a montan wax (OP WAX available from Hoechst AG) and 1 part by weight of an ethylene-vinyl acetate copolymer (Sumitate 31 available from Sumitomo Chemical) to prepare the desired composition for forming a release layer.

Preparation of a Composition for Forming a Solvent-Resistant Layer

In 28 parts by weight of a solvent MEK was dissolved 7 parts by weight of a polyester resin (UE3350 available from Unichika), while 3 parts by weight of a polyethylene wax (Sanwax 151P available from Sanyo Chemical Industries) was dispersed in 12 parts by weight of a solvent MEK.

The polyethylene wax dispersion was added to the polyester resin solution to prepare the desired composition for forming a solvent-resistant layer.

Preparation of a Composition for Forming an Ink Layer

In 30 parts by weight of a solvent MEK were dissolved 6 parts by weight of a ketone resin (Haron 80 available from Honshu Chemical Industry), 1 part by weight of a polyethylene wax (Sanwax 151P available from Sanyo Chemical Industries) and 3 parts by weight of carbon black (Printex L available from Degussa Corporation) to prepare the desired composition for forming an ink layer.

Preparation of a Thermal Transfer Recording Medium

The composition for forming a release layer was used to form a release layer on one face of a polyester film (available from Teijin) having a thickness of 5.0 $\mu$m by gravure coating, after which the solvent was evaporated.

Then, the composition for forming a solvent-resistant layer was used to form a solvent-resistant layer on the release layer by gravure coating, after which the solvent was evaporated.

Then, the composition for forming an ink layer was used to form an ink layer on the solvent-resistant layer by gravure coating and the solvent was evaporated to give the desired thermal transfer recording medium.

The thickness of each layer here was 0.5 g/m$^2$ for the release layer, 1.0 g/m$^2$ for the solvent-resistant layer and 1.0 g/m$^2$ for the ink layer.

EXAMPLE 2

A thermal transfer recording medium was prepared by the same procedure as in Example 1 except that 6 parts by weight of the polyester resin and 4 parts by weight of the polyethylene wax were incorporated into the solvent-resistant layer.

EXAMPLE 3

A thermal transfer recording medium was prepared by the same procedure as in Example 1 except that 5 parts by weight of the polyester resin and 5 parts by weight of the polyethylene wax were incorporated into the solvent-resistant layer.

EXAMPLE 4

A thermal transfer recording medium was prepared by the same procedure as in Example 1 except that 4 parts by weight of the polyester resin and 6 parts by weight of the polyethylene wax were incorporated into the solvent-resistant layer.

EXAMPLE 5

A thermal transfer recording medium was prepared by the same procedure as in Example 1 except that 3 parts by weight of the polyester resin and 7 parts by weight of the polyethylene wax were incorporated into the solvent-resistant layer.

EXAMPLE 6

A thermal transfer recording medium was prepared by the same procedure as in Example 1 except that 8 parts by weight of the polyester resin and 2 parts by weight of the polyethylene wax were incorporated into the solvent-resistant layer.

EXAMPLE 7

A thermal transfer recording medium was prepared by the same procedure as in Example 1 except that the composition for forming an ink layer was prepared by incorporating 3 parts by weight of a melamine resin in place of the polyethylene wax.

EXAMPLE 8

A thermal transfer recording medium was prepared by the same procedure as in Example 1 except that a composition for forming an ink layer containing no polyethylene wax was used to form an ink layer.

COMPARATIVE EXAMPLE 1

A thermal transfer recording medium was prepared by the same procedure as in Example 8 except that a composition for forming a solvent-resistant layer containing 10 parts by weight of the polyester resin with no addition of polyethylene wax was used to form a solvent-resistant layer.

COMPARATIVE EXAMPLE 2

A thermal transfer recording medium was prepared by the same procedure as in Example 8 except that a composition for forming a solvent-resistant layer containing 10 parts by weight of a polystyrene resin (ST120 available from Sanyo Chemical Industries) with no addition of polyethylene wax was used to form a solvent-resistant layer.

COMPARATIVE EXAMPLE 3

A thermal transfer recording medium was prepared by the same procedure as in Example 8 except that a composition for forming a solvent-resistant layer containing 10 parts by weight of an epoxy resin (CP-20 available from NOF CORPORATION) with no addition of polyethylene wax was used to form a solvent-resistant layer.

COMPARATIVE EXAMPLE 4

A thermal transfer recording medium was prepared by the same procedure as in Example 8 except that a composition for forming a solvent-resistant layer containing 10 parts by weight of a polymethyl methacrylate resin (BR-64 available from Mitsubishi Kasei) with no addition of polyethylene wax was used to form a solvent-resistant layer.

EVALUATIONS

The thermal transfer recording media were evaluated in the following evaluation aspects. The results are shown in Table 1.

TABLE 1

Evaluation results of thermal transfer recording media of Examples and Comparative examples

| | Solvent-resistant layer Polyester/ | PE-WAX | Ink layer | Coating properties | Solvent resistance | Printing quality | Sensitivity |
|---|---|---|---|---|---|---|---|
| Example 1 | 7 | 3 | Ketone resin/ PE WAX | ○ | ○ | ○ | ○ |
| Example 2 | 6 | 4 | Ketone resin/ PE-WAX | ○ | ○ | ○ | ○ |
| Example 3 | 5 | 5 | Ketone resin/ PE-WAX | ○ | Δ | ○ | ○ |
| Example 4 | 4 | 6 | Ketone resin/ PE-WAX | ○ | Δ | ○ | ○ |
| Example 5 | 3 | 7 | Ketone resin/ PE-WAX | ○ | Δ | ○ | ○ |
| Example 6 | 8 | 2 | Ketone resin/ PE-WAX | ○ | ○ | ○ | ○ |
| Example 7 | 7 | 3 | Ketone resin/ melamine | ○ | ○ | ○ | Δ |

TABLE 1-continued

Evaluation results of thermal transfer recording media of Examples and Comparative examples

| | Solvent-resistant layer Polyester/ | PE-WAX | Ink layer | Coating properties | Solvent resistance | Printing quality | Sensitivity |
|---|---|---|---|---|---|---|---|
| | | | resin | | | | |
| Example 8 | 7 | 3 | Ketone resin alone | ○ | ○ | Δ | ○ |
| Comparative Example 1 | 10 | 0 | Ketone resin alone | X | — | — | — |
| Comparative Example 2 | 10*1 | 0 | Ketone resin alone | X | — | — | — |
| Comparative Example 3 | 10*2 | 0 | Ketone resin alone | X | — | — | — |
| Comparative Example 4 | 10*3 | 0 | Ketone resin alone | X | — | — | — |

*1Polystyrene resin
*2Epoxy resin
*3Polymethyl methacrylate resin

1. Coating Properties

Evaluation standards here are as follows. ○: Coating properties are good over the whole length of the thermal transfer recording medium (ribbon); Δ: Unevenness of coating partially occurred or the unevenness affected the resulting print described below; ×: Unevenness of coating was too severe to prepare a thermal transfer recording medium.

2. Solvent Resistance

Immediately after a bar code image has been printed on the same label under the same conditions as used in the printing quality test described below, the label was applied on a movable platen of a color fastness tester with the bar code image facing upward and a weight having a weight of 400 g/cm$^2$ wrapped in a cloth wetted with a solvent (ethanol) was put thereon, and then the platen was laterally oscillated to rub the surface of the bar code image and count the number of cycles of the platen until this bar code image became contaminated.

Evaluation standards here are as follows. ◎: Especially excellent solvent resistance with more than 30 cycles; ○: Excellent solvent resistance with 20–30 cycles; Δ: Practically acceptable with 10–19 cycles; ×: Unsuitable for practical use with less than 10 cycles.

3. Printing Quality

Using a thermal transfer printer (ZEBRA-140Xi available from Zebra Technologies), a bar code image was formed on a PET (polyethylene terephthalate) label (Select 21830 available from FLEXCON) at a printing speed of 2 in. (5.08 cm)/sec.

This print was visually observed for missing dots.

Evaluation standards here are as follows. ○: The print shows favorable printing quality with no missing dots; Δ: The print shows some missing dots, but without inconvenience for practical use; ×: The print shows too many missing dots for practical use.

Evaluation Results

Table 1 shows that all of the thermal transfer recording media of Examples 1–8 had good coating properties.

When the amount of the polyethylene wax in the solvent-resistant layer was increased as shown in Examples 3–5, solvent resistance was somewhat lowered but remained at a practically acceptable level.

However, all of the thermal transfer recording media of Comparative examples 1–4 with no addition of polyethylene wax in the solvent-resistant layer were poor in coating properties.

ADVANTAGES OF THE INVENTION

The foregoing description demonstrates that the present invention provides thermal transfer recording media having a solvent-resistant layer based on a polyester resin wherein an even ink layer can be formed by coating on the solvent-resistant layer.

What is claimed is:

1. A process for preparing a thermal transfer recording medium, comprising the steps of:

applying a composition for forming a solvent-resistant layer mainly containing a polyester resin and a polyethylene wax on a substrate in the form of a film and drying it to form a solvent-resistant layer; and applying a composition for forming an ink layer based on a ketone resin on said solvent-resistant Layer and drying it to form an ink layer;

wherein a ratio of the polyester resin to the polyethylene wax in the solvent-resistant layer is from 3:2 to 4:1 parts by weight.

2. A process according to claim 1 wherein said composition for forming a solvent-resistant layer is prepared by adding a dispersion of the polyethylene wax in a solvent to a solution of the polyester resin in a solvent.

3. A process according to claim 1 wherein methyl ethyl ketone is used as the solvent.

4. A process according to claim 1 wherein the composition for forming a solvent-resistant layer is applied and then dried under the conditions where the polyethylene wax in the solvent-resistant layer should not be molten.

5. The process according to claim 1 wherein the polyethylene wax is contained in the range from 20 to 40% by weight on the basis of the solid content of the solvent-resistant layer.

6. The process according to claim 1 wherein the polyethylene wax is contained in the range from 30 to 70% by weight on the basis of the solid content of die solvent-resistant layer.

* * * * *